US009302871B2

(12) United States Patent
Breineder et al.

(10) Patent No.: US 9,302,871 B2
(45) **Date of Patent: *Apr. 5, 2016**

(54) ROLL WITH SENSORS FOR A MACHINE FOR PRODUCING AND/OR PROCESSING A MATERIAL WEB AND MACHINE FOR PRODUCING AND/OR PROCESSING A MATERIAL WEB

(71) Applicant: VOITH PATENT GMBH, Heidenheim (DE)

(72) Inventors: Martin Breineder, Natschbach (AT); Hubert Bischof, Muerzzuschlag (AT); Matthias Schmitt, Munich (DE); Yang Shieh, Wallingford, PA (US)

(73) Assignee: Voith Patent GmbH, Heidenheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/372,053

(22) PCT Filed: Jan. 8, 2013

(86) PCT No.: PCT/EP2013/050182

§ 371 (c)(1),
(2) Date: Jul. 14, 2014

(87) PCT Pub. No.: WO2013/104600

PCT Pub. Date: Jul. 18, 2013

(65) Prior Publication Data

US 2014/0374460 A1 Dec. 25, 2014

(30) Foreign Application Priority Data

Jan. 12, 2012 (DE) ..... 10 2012 200 387

(51) Int. Cl.
*B65H 20/02* (2006.01)
*D21F 3/06* (2006.01)

(Continued)

(52) U.S. Cl.
CPC ..... *B65H 20/02* (2013.01); *B65H 43/00* (2013.01); *D21F 3/06* (2013.01); *D21F 3/08* (2013.01); *D21F 3/105* (2013.01); *D21G 1/0233* (2013.01); *D21G 1/0286* (2013.01)

(58) Field of Classification Search
USPC ..... 162/263; 226/45; 492/9
IPC ..... B65H 20/02,43/00; D21F 3/105
See application file for complete search history.

(56) References Cited

U.S. PATENT DOCUMENTS 4,368,568 A 1/1983 Watanabe
5,562,027 A 10/1996 Moore (Continued)

FOREIGN PATENT DOCUMENTS

EP 2267219 A1 12/2010
EP 2392728 A1 12/2011

(Continued)

*Primary Examiner* — Mark Halpern
(74) *Attorney, Agent, or Firm* — Laurence A. Greenberg; Werner H. Stemer; Ralph E. Locher

(57) ABSTRACT

A roll for a machine for processing a material web, in particular a paper, cardboard, or tissue machine, has a cylindrical roll core and a roll cover which is arranged on the radially outer lateral face of the roll core. The roll cover has a functional layer and a connecting structure which lies radially between the roll core and the functional layer. The radially outer lateral face of the functional layer provides a contact surface which can be brought into contact with the material web or a covering. A plurality of pressure and/or temperature-sensitive sensors are embedded in the roll cover. The sensors are arranged in the connecting structure or at the interface between the connecting structure and the functional layer.

18 Claims, 2 Drawing Sheets

(51) Int. Cl.

| | |
|---|---|
| ***D21F 3/08*** | (2006.01) |
| ***D21F 3/10*** | (2006.01) |
| ***D21G 1/02*** | (2006.01) |
| ***B65H 43/00*** | (2006.01) |

(56) References Cited

U.S. PATENT DOCUMENTS

| | | | | |
|---|---|---|---|---|
| 8,346,501 | B2 | 1/2013 | Pak | |
| 8,474,333 | B2 | 7/2013 | Berendes | |
| 8,475,347 | B2 | 7/2013 | Gustafson | |
| 2010/0324856 | A1* | 12/2010 | Pak | 702/138 |
| 2011/0301003 | A1* | 12/2011 | Gustafson et al. | 492/10 |
| 2013/0288868 | A1 | 10/2013 | Gustafson | |
| 2013/0345035 | A1 | 12/2013 | Berendes | |

FOREIGN PATENT DOCUMENTS

| | | | |
|---|---|---|---|
| GB | 2057092 | A | 3/1981 |
| WO | 2010034321 | A1 | 4/2010 |
| WO | 2012113747 | A1 | 8/2012 |

* cited by examiner

ROLL WITH SENSORS FOR A MACHINE FOR PRODUCING AND/OR PROCESSING A MATERIAL WEB AND MACHINE FOR PRODUCING AND/OR PROCESSING A MATERIAL WEB

This application is a 371 of PCT/EP2013/050182 filed 8 Jan. 2013

BACKGROUND OF THE INVENTION

Field Of The Invention

The invention relates to a roll with a number of sensors for use in a machine processing a material web. The invention also relates to a machine processing a material web that is equipped with such sensors. The machine processing a material web is, in particular, a paper, cardboard or tissue machine.

In the production of a paper, cardboard or tissue web, a fiber suspension is applied in the forming section to a forming screen and dewatered. The further dewatering takes place after the forming operation in the pressing and drying sections. In the pressing section, for example, the web of fibrous material is passed through a series of pressing nips, which are respectively formed by two interacting rolls, i.e. a roll and a counter-roll. The pressure profile forming in the nips as the web of fibrous material passes through, in particular in the transverse direction of the machine, has a significant influence on whether the fibrous material produced can be made with the same properties over the entire width thereof. Furthermore, the efficiency of the dewatering depends greatly on a homogeneous pressure profile in the transverse direction of the machine. For instance, if there is an uneven pressure distribution in the nip, the web of fibrous material has an uneven moisture profile in the transverse direction of the machine. Paper manufacturers are therefore anxious to monitor the pressure profiles in the pressing nip while operation is in progress.

To monitor the pressure profile in the nip while operation is in progress, sensors are used, as described for example in U.S. Pat. No. 5,562,027. The sensors are arranged here in the roll covering, in order to be protected from direct exposure to ambient influences. In this prior art, various types of sensors are proposed, such as for example piezoelectric sensors or fiber-optic sensors.

It has been found in the practical application of such rolls with sensors that the sensors embedded in the roll covering often fail after a short time during operation in the machine because of high mechanical loading, in particular pressure loading. Furthermore, the sensors are often destroyed during servicing of the rolls, in which part of or the entire functional layer of the roll covering is removed by turning and renewed. For this reason, in the past sensors have often been arranged at the interface between the roll core and the roll covering. However, a disadvantage of this solution is that the compressive forces acting on the surface of the roll can only be measured very inaccurately and weakly on account of the very deep embedment of the sensors in the roll covering. Furthermore, in the past sensors have been fitted in the functional layer of the roll covering. In particular in the case of roll coverings with a functional layer of polyurethane, such sensors have been found to act as foreign bodies, which may even be responsible for instances of crack formation and delamination in the functional layer.

BRIEF SUMMARY OF THE INVENTION

The present invention addresses the problem of proposing a roll with sensors that has greater long-term stability during operation, in the case of which the sensors cannot be destroyed during servicing of the roll and which supplies reliable measuring signals. The present invention also addresses the problem of proposing a machine for producing and/or processing a web of fibrous material comprising a roll with sensors.

The problem is solved by a roll for a machine for producing and/or processing a material web, in particular a paper, cardboard or tissue machine, comprising a cylindrical roll core and a roll covering arranged on the lateral surface of the roll core. Here, the roll covering is formed by a functional layer and a connecting structure, which connects the roll core to the functional layer and comprises one or more connecting layers. The roll according to the invention also comprises a number of pressure- and/or temperature-sensitive sensors, which are embedded in the roll covering. The roll according to the invention is characterized in that the sensors are embedded in the at least one connecting layer or are arranged on the radially outer lateral surface of one of the at least one connecting layers.

The solution according to the invention provides that the sensors are arranged in a position in the roll covering in which the sensors generally cannot be destroyed during the servicing of the roll, since the roll covering is generally not removed over the full thickness of the functional layer during the servicing of the roll. Furthermore, the risk of sensors being destroyed during operation is greatly reduced by the solution according to the invention, since the sensors are embedded sufficiently deeply in the roll covering. The fact that the sensors are not however arranged on the lateral surface of the roll core but within the roll covering means that a sufficiently high signal sensitivity of the sensors is provided. The fact that the sensors are not arranged in the functional layer but in the connecting structure or at the interface between the connecting structure and the functional layer also means that the tendency for crack formation or delamination in the functional layer is effectively reduced.

When the term "radial" or "radial direction of the roll" is used in the context of this invention, it should be understood as meaning the direction of the radial extent of the roll.

When the term "axial" or "axial direction of the roll" is used in the context of this invention, it should be understood as meaning all straight lines that extend parallel to the longitudinal axis of the roll.

The term "layer" should be understood within the context of the present invention as meaning a hollow-cylindrical portion of material of the roll covering of which the wall thickness, also referred to as the thickness, is at least 1.0 mm and which consists of one or more materials, the material composition of which is homogeneous along its radial and axial extents. The term "layer" should also be understood within the context of the present invention as meaning a hollow-cylindrical portion of material of the roll covering that consists of a number of materials of which the composition—such as for example parts by weight of the individual materials in the material composition—changes continuously along the radial extent of the portion.

The term "functional layer" should be understood within the context of the present invention as meaning the layer of which the radially outer lateral surface provides a contact surface that can be brought into contact with a material web or a fabric covering and becomes at least partially worn during the operation of the roll.

Advantageous refinements and developments of the invention are specified in the subclaims.

If the connecting structure only comprises one connecting layer, the sensors may either be embedded in the connecting layer or be arranged on the radially outer lateral surface of the connecting layer. If the connecting structure comprises, the sensors may be embedded in one of the connecting layers of the connecting structure or be arranged on the radially outer lateral surface of one of the connecting structures. The radially outer lateral surface of the connecting layer concerned should be understood here as meaning the lateral surface of the hollow-cylindrical connecting layer that is radially on the outside.

A preferred refinement of the invention provides that the connecting layer in which the sensors are embedded or on the radially outer lateral surface of which the sensors are arranged has a greater hardness and/or a greater modulus of elasticity than the functional layer. In this case, the connecting layer forms a stable base for the sensors, on which the sensors can be supported mechanically stably without being exposed to high flexural forces. (Since the functional layer is softer and/or more elastic than the connecting layer in which the sensors are embedded, a pressure pulse acting on the radially outer lateral surface of the functional layer can propagate through the functional layer and activate the sensors to emit a signal.)

Depending on the specific intended use and/or on the configuration of the functional layer of the roll according to the invention, the connecting structure may comprise a single connecting layer or a number of connecting layers that are arranged one over the other—as seen in the radial direction of the roll.

It is also conceivable for example that each of the connecting layers has a greater hardness and/or a greater modulus of elasticity than the functional layer.

If the connecting structure has a number of connecting layers, it is also conceivable that the radially innermost of the connecting layers has a greater hardness and/or a greater modulus of elasticity than the other connecting layers. Furthermore, in the case of a number of connecting layers, it is conceivable that the hardness and/or the modulus of elasticity of the connecting layers increases from layer to layer from the radially innermost to the radially outermost connecting layer.

It is preferably conceivable that the radially innermost connecting layer is formed from hard rubber or comprises hard rubber as a major constituent. This connecting layer may for example have a hardness in the range of 76-86 Shore D.

As an alternative to this, it is conceivable that the radially innermost connecting layer is formed from a fiber composite material or comprises fiber composite material as a major constituent. The fiber composite material may be formed here by fibers that are wound in a number of layers around the lateral surface of the roll core and embedded in a resin. The fibers may take the form here of a textile fabric in strip form, in particular as a strip of woven material or strip of nonwoven material. It is also conceivable that the fibers are in the form of a fiber bundle, known as a fiber roving. Furthermore, the fibers may comprise or have as a significant constituent glass and/or carbon fibers. This connecting layer may for example have a hardness in the range of 88-92 Shore D.

According to one possible refinement of the invention, it is conceivable that a further connecting layer lying between the radially innermost connecting layer and the functional layer is formed from hard rubber or rubber or comprises hard rubber or rubber as a major constituent and that the further connecting layer has a hardness and/or a modulus of elasticity that is between that of the radially innermost connecting layer and the functional layer.

It is also conceivable that the sensors are embedded in this further connecting layer or are arranged on the radially outer lateral surface thereof.

When it is mentioned in the previous or subsequent paragraphs that a layer comprises a material or material composition as a major constituent, this means that this material or this material composition occurs in the layer as 70 percent by weight (% by weight) or more, with preference 80% by weight or more, with particular preference 90% by weight or more. Such a layer may then also contain other materials or material compositions that are formed for example as particulate and/or fibrous fillers.

If for example the functional layer consists of polyurethane or has polyurethane as a major constituent, it is conceivable that the connecting structure comprises at least one connecting layer that is formed from a fiber composite material or comprises the latter as a major constituent, it being possible for the connecting layer to be made with or from the fiber composite material, for example as described in the previous paragraph. It is conceivable that, in the case of a functional layer that is of polyurethane or has polyurethane as a major constituent, the connecting structure has only one connecting layer, and this connecting layer is formed from a fiber composite material or comprises the latter as a major constituent.

If for example the functional layer consists of rubber or has rubber as a major constituent, it is conceivable that the connecting structure comprises two or more connecting layers and at least two of the connecting layers are formed from rubber and/or hard rubber or contain rubber and/or hard rubber as a major constituent. It is conceivable here in particular that the two aforementioned connecting layers have different hardnesses.

A number of possibilities for the arrangement of the sensors in the connecting structure are conceivable, it being possible for the arrangement of the sensors to be dependent on the intended use of the roll according to the invention and/or on the structure of the roll covering.

It is thus conceivable that the sensors are embedded in the radially outermost connecting layer or are arranged on the radially outer lateral surface thereof. In this case, the sensors are arranged relatively close to the functional layer, for which reason even extremely small pressure pulses can be registered. A further advantage of this embodiment applies to the case where the sensors are temperature sensors, in that the temperature in the roll covering can be measured in the region of the interface of the connecting structure and the functional layer or adjacent this interface, whereby failure of the roll covering due to overheating can be effectively prevented because failure of the roll covering on account of overheating often occurs in the region of the transition from the connecting structure to the functional layer.

It is also conceivable that the sensors are embedded in the radially innermost connecting layer or are arranged on the radially outer lateral surface thereof. If the roll covering comprises a number of connecting layers, in this case the sensors are arranged relatively far away from the functional layer, for which reason this arrangement is suitable for example for applications in which high pressure pulses occur or in the case of a structure of the roll covering comprising relatively soft layers.

In addition, it is conceivable that the sensors are embedded in a connecting layer or are arranged on the radially outer lateral surface thereof that lies between the radially innermost and radially outermost connecting layers.

It goes without saying that it is also possible that not all of the sensors are arranged in the same radial position, but that there is a combination of the aforementioned positions.

The connecting layer in which the sensors are embedded or on the radially outer lateral surface of which the sensors are arranged may be of hard rubber or rubber or comprise hard rubber or rubber as a major constituent. It is specifically conceivable for example here that the sensors are embedded in the radially innermost connecting layer or are arranged on the radially outer lateral surface thereof and the radially innermost connecting layer is of rubber or hard rubber or comprises rubber or hard rubber as a major constituent.

The connecting layer in which the sensors are embedded or on the radially outer lateral surface of which the sensors are arranged may also be of fiber composite material or comprise fiber composite material as a major constituent. It is conceivable here for example that the sensors are embedded in the radially innermost connecting layer or are arranged on the radially outer lateral surface thereof and the radially innermost connecting layer is of fiber composite material or comprises fiber composite material as a major constituent.

In order to increase the response of fiber optic sensors in particular, with preference fiber Bragg gratings, it is of advantage in particular if the sensors are supported on a defined base. If for example the sensors are arranged between two layers, the sensors are supported on the radially outer lateral surface of the lower of the two layers. In this case, it may for example be appropriate for production engineering reasons if the locations of the radially outer lateral surface of the lower layer at which the sensors are arranged are not recessed with respect to the other portions of this lateral surface. If for example the roll according to the invention is a suction roll, the lateral surface of the respective connecting layer may contain depressions in the form of through-holes or blind holes, in which the sensors should not be arranged. The locations at which the sensors should be arranged and supported should not however be recessed with respect to the remaining portions of the lateral surface.

If for example the sensors are embedded in a connecting layer, it is conceivable to construct this connecting layer from two portions. In this case, it is conceivable firstly to form the first portion in such a way that its radially outer surface forms a cylindrical lateral surface which does not have any depressions—apart from any depressions there may be as a result of suction holes or sag holes in the case of a suction roll—and on which the sensors are placed before the second portion of this connecting layer is formed and thereby covers the first portion and the sensors.

A specific refinement for the embedding of the sensors in a connecting layer formed from a fiber composite material provides for example that firstly the inner lying first portion, as seen in the radial direction of the roll, and then the second portion, lying radially outside on the inner first portion, is formed, the first portion being formed from a first number of layers of wound fibers and its surface being ground smooth, the sensors then being arranged on the smoothly ground surface of the first portion and the second portion subsequently being formed, in that a second number of layers of fibers are wound around the arrangement comprising the surface of the first portion and the sensors, the second number being smaller than the first number. Preferably, the second portion is formed here from a maximum of ten layers, in particular a maximum of five layers of fibers that are wound and embedded in resin material.

The connecting structure may also comprise at least one bonding coat with a thickness of less than 1 mm, the bonding coat comprising in particular a resin, such as for example epoxy resin, with chopped fibers embedded therein. Such a bonding coat may for example be formed by a coating and for example have a thickness in the range from 100 μm to 800 μm. The resin may for example be a multistage-curing resin, in particular epoxy resin, which cures successively at different temperatures. Such a bonding coat may for example be arranged between the roll core and the radially innermost connecting layer and/or between the radially outermost connecting layer and the functional layer and/or between two connecting layers. If a multistage-curing resin is used for the bonding coat and if this bonding coat is arranged between two layers—either between two connecting layers or between a connecting layer and the functional layer —, a multistage-curing resin that partly cures at the curing temperature of the polymer of the one layer and completely cures at the curing temperature of the polymer of the other layer may be chosen.

The functional layer may comprise polyurethane, rubber or a fiber composite material as a major constituent or be formed from one of the aforementioned materials.

The functional layer may have a thickness in the range of 6-15 mm. Furthermore, the connecting structure may have a thickness in the range of 1-10 mm. Furthermore, each connecting layer of the connecting structure may have a thickness in the range of 1-10 mm.

A possible, but not definitive, representation of combinations for the functional layer, connecting structure and sensor arrangement can be taken from the following table (note: the sequence of the connecting layers on top of one another, beginning from the roll core to the functional layer, corresponds to their numbering, beginning with the smallest number; bonding coats that are possibly present are not mentioned.

| | PU roll | Rubber roll | Rubber roll | Rubber roll | Rubber roll | Composite roll |
|---|---|---|---|---|---|---|
| Functional layer | | | | | | |
| Material | Polyurethane | Rubber | Rubber | Rubber | Rubber | Epoxy resin/fibers |
| Thickness | 10-20 mm | 10-20 mm | 10-20 mm | 10-20 mm | 10-20 mm | 5-15 mm |
| Hardness | 60-100 Shore A | 60-100 Shore A | 60-100 Shore A | 60-100 Shore A | 60-100 Shore A | 80-90 Shore A |
| Connecting structure | | | | | | |
| 1st connecting layer (D = thickness of the | Epoxy resin/glass fiber; thickness = 1-10 mm; hardness = | Epoxy resin/glass fiber; thickness = 1-10 mm; hardness = | Hard rubber; thickness = 1-10 mm; hardness = 88-92 | Hard rubber; thickness = 1-10 mm; hardness = 88-92 | Epoxy resin/glass fiber; thickness = 1-10 mm; hardness = | Epoxy resin/glass fiber; thickness = 1-10 mm; hardness = |

-continued

| | PU roll | Rubber roll | Rubber roll | Rubber roll | Rubber roll | Composite roll |
|---|---|---|---|---|---|---|
| layer) | 88-92 Shore D | 88-92 Shore D | Shore D | Shore D | 88-92 Shore D | 88-92 Shore D |
| 2nd connecting layer | — | Rubber; thickness = 1-10 mm; hardness = 5-10 P&J | Rubber; thickness = 1-10 mm; hardness = 5-10 P&J | Rubber; thickness = 1-10 mm; hardness = 5-10 P&J | Rubber; thickness = 1-10 mm; hardness = 76-86 Shore D | — |
| 3rd connecting layer | | | | | Rubber; thickness = 1-10 mm; hardness = 5-10 P&J | |
| Position sensors | Within 1st connecting layer | Interface between 1st and 2nd connecting layers | Interface between 1st and 2nd connecting layers | Within 1st or 2nd connecting layer | Interface between 1st and 2nd connecting layers | Within 1st connecting layer |

A most particularly preferred refinement of the invention provides that, as seen in the radial direction of the roll, the sensors are arranged at a height in the connecting structure that corresponds to 50% or more, in particular 80% or more, of the thickness of the connecting structure.

The terms height and thickness should be understood here as follows. The connecting structure has a radially inner lateral surface—facing the roll core—and a radially outer lateral surface—facing the functional layer. The thickness of the connecting structure is determined by the radial distance from the radially outer lateral surface to the radially inner lateral surface. The height should always be seen as starting from the radially inner lateral surface, i.e. a height of 50% or more is intended to mean that the sensors are arranged midway between the two lateral surfaces or closer to the radially outer lateral surface than to the radially inner lateral surface. A height of 80% is intended to mean that, with respect to the distance between the two lateral surfaces, the sensors are 80% away from the radially inner lateral surface and 20% away from the radially outer lateral surface.

Tests have shown that the positional particulars specified above for the arrangement of the sensors in the connecting structure represent an optimum balance between good signal sensitivity and low sensitivity to mechanical damage of the sensors, in particular when fiber-optic sensors are used. Some fiber-optic sensors, such as for example fiber Bragg grating sensors, are strain sensors, which under the effect of pressure are stretched or compressed and supply a signal proportional to the stretching or compressing, which can be converted into a pressure signal by means of a calibration. In the case of the arrangement of such fiber-optic sensors at a height in the connecting structure that corresponds to 50% or more of the thickness of the connecting structure, very good signal sensitivity is achieved, combined with a great insensitivity to damage of the glass-fiber sensors.

Furthermore, a preferred refinement of the invention provides that the connecting layer in which the sensors are embedded has a thickness, as seen in the radial direction of the roll, and the sensors are arranged in the connecting layer at a height in the radial direction that corresponds to 60% or more of the thickness of the connecting layer.

Preferably, at least some, in particular all, of the sensors are fiber-optic sensors. In this case, it is particularly advantageous if at least one optical waveguide that comprises fiber-optic sensors is provided. In this case, the fiber-optic sensors may either be arranged on one optical waveguide or be distributed over a number of optical waveguides.

The fiber-optic sensors are in particular fiber Bragg gratings. A fiber Bragg grating may be produced for example by incorporating a Bragg grating in the optical waveguide by recording.

Preferably, the fiber-optic sensors are arranged here at a distance from one another along the respective optical waveguides. In the case where the fiber-optic sensors are fiber Bragg gratings, this means that an optical waveguide has portions that respectively contain a fiber Bragg grating (referred to hereinafter as portions with a fiber Bragg grating), alternating with portions that are free from a fiber Bragg grating (referred to hereinafter as portions without a fiber Bragg grating), i.e. between two portions with a fiber Bragg grating there is respectively arranged a portion without a fiber Bragg grating, and vice versa.

With preference, the at least one optical waveguide has a diameter of at most 750 μm, with particular preference at most 500 μm, with most particular preference of at most 300 μm. Such optical waveguides with fiber-optic sensors are distinguished by particularly small dimensions. This makes it possible to use sensors also in rolls known as suction rolls, that is to say rolls with suction holes that extend from the outer lateral surface of the functional layer through the entire roll covering into the interior of the roll core. Furthermore, on account of their small dimensions, such optical waveguides do not act as foreign bodies in the connecting structure that may lead to the failure of the roll covering, for example as a result of crack formation or the like. If the connecting layer in which the fiber-optic sensors are embedded consists for example of fibers embedded in resin, in particular glass fibers, fiber-optic sensors that are the component part of an optical waveguide with or without glass fiber also have the advantage that the optical waveguide or waveguides with the sensors do not act as a foreign body in the roll covering, since the optical waveguide or waveguides consist(s) of the same material as the fibrous material of the connecting layer in which the waveguide or waveguides is or are embedded.

Tests conducted by the applicant have shown that the sensitivity of the sensors formed as fiber Bragg gratings for pressure measurement can be increased if the optical waveguide or waveguides is or are aligned in the region of the fiber Bragg gratings in such a way that it (they) respectively forms or form with the circumferential direction of the roll an angle of at most 45°, with preference at most 30°, with particular preference at most 10°.

With preference, at least some, in particular all, of the portions without a fiber Bragg grating of the same optical waveguide run in a curved manner. With particular preference, each portion without a fiber Bragg grating respectively runs in a curved manner in only one direction. Furthermore, according to a further particularly preferred refinement of the invention, it is provided that respectively adjacent portions without a fiber Bragg grating of the same optical waveguide run in a curved manner in opposing directions.

Preferably, some, in particular all, of the sensors formed as fiber Bragg gratings have Bragg wavelengths that are different from one another.

It is conceivable in this connection in particular that all of the fiber Bragg gratings of the same optical waveguide have Bragg wavelengths that are different from one another. If a number of optical waveguides with fiber Bragg gratings are provided, it may be that the fiber Bragg gratings of the same optical waveguide respectively have Bragg wavelengths that are different from one another, but the different optical waveguides have fiber Bragg gratings with the same Bragg wavelengths, i.e. there are Bragg fiber gratings of different optical waveguides that have the same Bragg wavelengths. It is also conceivable, however, in the case of a number of optical waveguides with in each case a number of fiber Bragg gratings that all of the fiber Bragg gratings of all of the optical waveguides have Bragg wavelengths that are different from one another, i.e. there are no two Bragg fiber gratings that have the same Bragg wavelength.

It is conceivable in this connection that the fiber Bragg gratings of the same optical waveguide respectively have a Bragg wavelength offset from one another by 0.1-100 nm, in particular 0.5-50 nm, with particular preference 1-15 nm, the spacing of the Bragg wavelengths of adjacent Bragg fiber gratings with preference being the same in each case. Thus, for example, it is conceivable that one of the fiber Bragg gratings of an optical waveguide has a Bragg wavelength of X nm, the fiber Bragg grating arranged upstream of this fiber Bragg grating in the longitudinal direction of this optical waveguide has a Bragg wavelength of X nm minus 0.5-30 nm and the fiber Bragg grating arranged downstream of the first-mentioned fiber Bragg grating in the longitudinal direction of this optical waveguide has a Bragg wavelength of X nm plus 0.5-30 nm, the spacing of the Bragg wavelengths from one another with preference being the same in each case.

The use of fiber Bragg gratings with different Bragg wavelengths makes it possible for the roll according to the invention to be operated particularly simply, since the various sensors can be activated by a broadband optical signal, for example in the IR wavelength range, and the sensors then return a reflection signal, which for each sensor lies at a wavelength characteristic of it, whereby the respective sensor signal can be assigned in a simple way to each sensor, and as a consequence to the respective location at which the pressure and/or temperature effect took place.

A further preferred refinement of the invention provides that a number of sensors are provided, in particular fiber-optic sensors, which are arranged one behind the other as seen in the circumferential direction of the roll. This arrangement allows for example the pressure and/or temperature profile in the direction of the machine in a roll nip to be measured.

It is conceivable furthermore that the roll comprises a number of sensors, in particular fiber-optic sensors, which are arranged one behind the other in the axial direction of the roll. It is conceivable furthermore that the sensors are arranged over at least 80% of the length that is usable during the operation of the roll, in particular 90% of the length of the roll that is usable during the operation of the roll.

It is conceivable in this connection in particular that the sensors arranged one behind the other in the axial direction of the roll are arranged along a straight line extending in the axial direction of the roll. Such sensor arrangements allow for example the pressure and/or temperature profile in the transverse direction of the machine in a roll nip to be measured.

It is also conceivable that the sensors arranged one behind the other in the axial direction of the roll are not arranged at the same position as seen in the circumferential direction of the roll, but are arranged in a region that has in the circumferential direction of the roll a width of at most 20 cm, with preference at most 10 cm. A number of sensors arranged one behind the other in the axial direction of the roll that are arranged either along a straight line or in the aforementioned region are to be referred to from now on as a row of sensors.

Preferably, the sensors of the at least one row of sensors are arranged in the axial direction of the roll over a length of at least 80%, in particular at least 90%, of the length that is usable during the operation of the roll.

It is conceivable furthermore, in particular, that each row of sensors is arranged on an optical waveguide.

It is also conceivable that the roll has a number of rows of sensors running parallel to one another, the individual rows of sensors being arranged offset from one another as seen in the circumferential direction of the roll. In this case, the sensors of a row of sensors are respectively arranged one behind the other along a straight line or within the aforementioned region, the straight lines or regions extending parallel to one another. This embodiment may also be regarded as an independent concept of the invention that is independent of the first concept of the claimed invention. It is conceivable in this connection for example that the individual rows of sensors are arranged offset from one another, as seen in the circumferential direction of the roll, by 90° or by 180° .

It is conceivable furthermore that the roll has an even number of rows of sensors arranged offset from one another in the circumferential direction.

If the roll comprises a number of rows of sensors parallel to one another, it is for example also conceivable that not all of the rows of sensors are operated simultaneously. In this case it is conceivable that at least one of the rows of sensors is only brought into operation when another of the rows of sensors is defective or is no longer operating faultlessly. It is ensured by this embodiment that the roll according to the invention can continue to operate in the papermaking machine even when a row of sensors is defective and, under normal circumstances, the machine would have to be stopped and the roll exchanged. This embodiment may also be regarded as an independent concept of the invention that is independent of the first concept of the claimed invention.

When there are at least two rows of sensors arranged offset from one another in the circumferential direction, it is preferred here that the sensors of one row of sensors with respect to the sensors of the other row of sensors are arranged offset from one another, as seen in the axial direction of the roll, i.e. there is at least one sensor of one row of sensors that is arranged between two sensors of the other row of sensors, as seen in the axial direction of the roll. For example, in this connection, between successive sensors of one of the rows of sensors there is respectively arranged a sensor of another row of sensors. This allows the spatial resolution in the measurement of the pressure and/or temperature profile in the transverse direction of the machine to be doubled.

The roll may be formed as a suction roll, and consequently comprise suction bores and optionally in addition blind bores. On account of their small diameter of 500 μm or less, with preference 250 μm or less, fiber-optic sensors arranged on one or more optical waveguides are particularly well-suited for suction rolls, in allowing them to be easily led between the suction openings.

According to a further independent aspect of the present invention, a machine for producing and/or processing a material web, in particular a web of fibrous material, such as for example a web of paper, cardboard or tissue, is claimed, said machine having a roll nip which is formed by a first and a second roll and through which the material web can be led, at least one of the two rolls being the roll with the sensors as claimed.

Preferably, the machine comprises an evaluation unit which communicates with the sensors and by which the signals generated by the sensors can be evaluated and further processed while the operation of the machine is in progress, i.e. on-line.

The evaluation unit may comprise an open-loop and/or closed-loop control unit, by means of which the operating state of the machine can be controlled. Preferably, the signals generated by the sensors are transmitted here to the evaluation unit by means of wireless communication, such as for example on the basis of Bluetooth or WLAN technology. For this purpose, a sending unit, arranged in the roll with the sensors but outside the roll covering, and a receiving unit, arranged outside the roll with the sensors and wirelessly communicating with the sending unit, may preferably be provided. The sending unit receives here signals from the sensors and transmits them wirelessly to the receiving unit, which in turn receives these signals and transmits them to the evaluation unit. The arrangement of the sending unit outside the roll covering means that the evaluation unit is completely isolated from the high mechanical loads that occur in the roll covering during the operation of the machine. As a result, the reliability of the system is significantly increased. It is conceivable in this connection that the sending unit is arranged for example in the region of one of the side covers of the roll or within the roll core. The first of the two variants given by way of example is particularly preferred here, since it has the effect that the sending unit is very easily accessible for any kind of assembly, servicing and/or repair work. Furthermore, the sensors are advantageously connected to the sending unit by way of an electrical and/or optical cable connection, it being possible here for optical and/or electrical components in which the signals generated by the sensors are further processed before they are passed on to the sending unit to be connected between the sensors and the sending unit.

The receiving unit arranged outside the roll with the sensors may for example be located in the control center of the machine, or else also be mobile, for example arranged on a carriage.

In order for example to prevent damage to the roll comprising the sensors being caused by local overheating within the roll covering as a result of flexing work or local overloading, for example when a foreign body such as for example a knot of paper passes through the roll nip, the open-loop and/or closed-loop control unit is preferably formed in such a way that it ensures that the temperature in the roll covering does not rise above a defined critical temperature value. In the case of such a solution, at least one of the sensors is a temperature sensor, with which a signal representing the temperature in the roll covering is measured. The open-loop and/or closed-loop control unit communicating with the temperature sensor is designed here in such a way that, depending on the measured temperature value, it outputs at least one control signal influencing the operating state of the machine, in such a way that an increase in the temperature of the roll covering beyond a defined critical temperature value is counteracted by changing the operating state of the machine. The temperature value may for example be the temperature itself, and also for example the change over time of the temperature in the roll covering. To influence the operating state of the machine, the open-loop and/or closed-loop control unit may for example bring influence to bear on one or more actuators and/or motors and the like that communicate with said unit and influence the operating state of the machine. Thus, for example, the production rate of the machine and/or the pressure profile in the roll nip and/or the position of the two rolls of the roll nip in relation to one another can be controlled by the actuator or actuators. The at least one temperature sensor may output a temperature signal to the open-loop and/or closed-loop control unit continually, i.e. at a time interval set as desired, such as for example every 5-20 seconds. In response to each temperature signal, at least one control signal may be output by the open-loop and/or closed-loop control unit, in order to adapt the operating state continually to the temperature signal. As an alternative to this, it is also conceivable that a control signal is only output by the open-loop and/or closed-loop control unit whenever a critical temperature value is exceeded.

The roll nip may furthermore be part of a pressing section for dewatering the web of fibrous material or part of an application unit for applying a pasty or liquid medium to the web of fibrous material or part of a calender for smoothing the web of fibrous material.

This embodiment may also be regarded as an independent concept of the invention that is independent of the first concept of the claimed invention.

The invention is explained further on the basis of drawings, which show one possible embodiment of the invention and in which:

DESCRIPTION OF THE INVENTION

Figure 1:
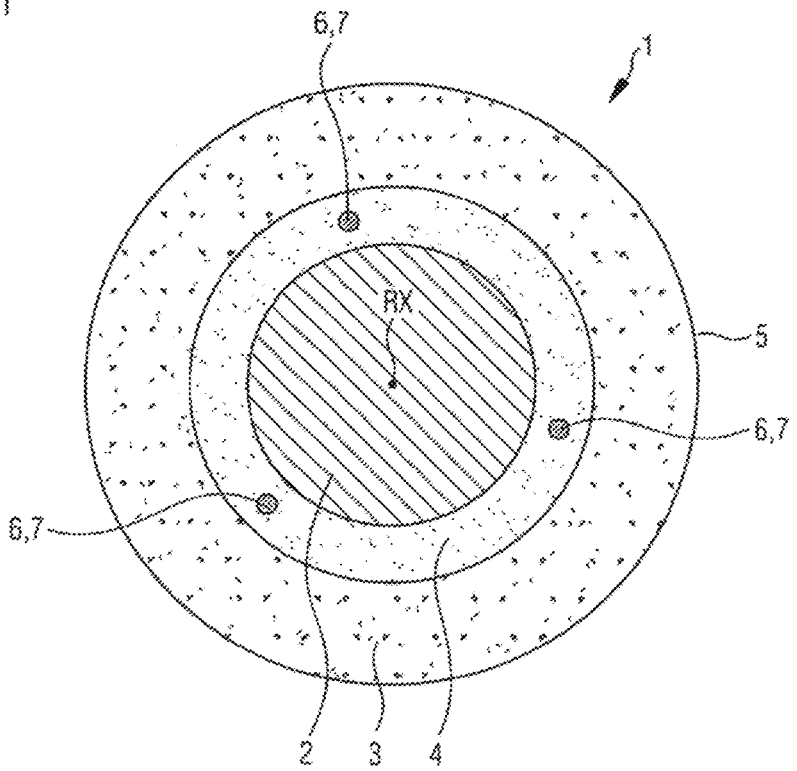
FIG. 1 shows a roll according to the invention with sensors in section in the radial direction of the roll.

The roll 1 represented in FIG. 1 has a cylindrical roll core 2, the lateral surface of which is surrounded by a roll coating comprising a functional layer 3 and a connecting structure 4.

Figure 2:
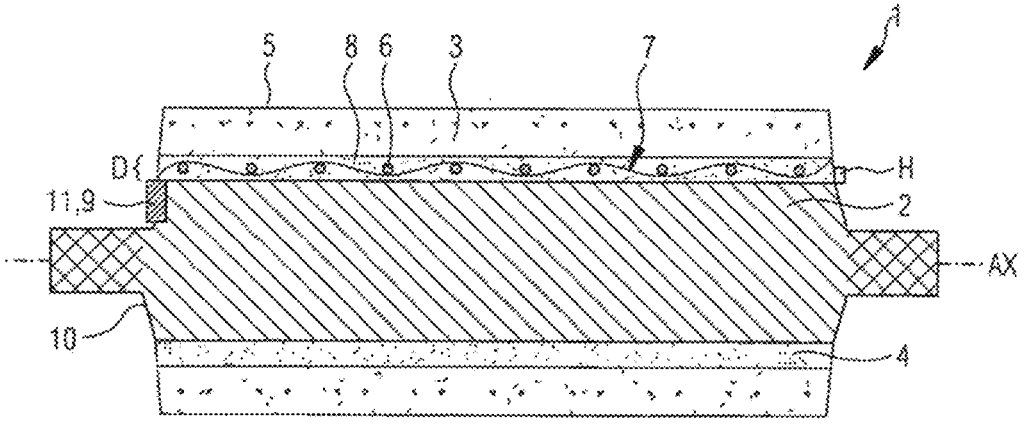
FIG. 2 shows the roll from FIG. 1 in a sectional plane in the axial direction of the roll.
Figure 3:
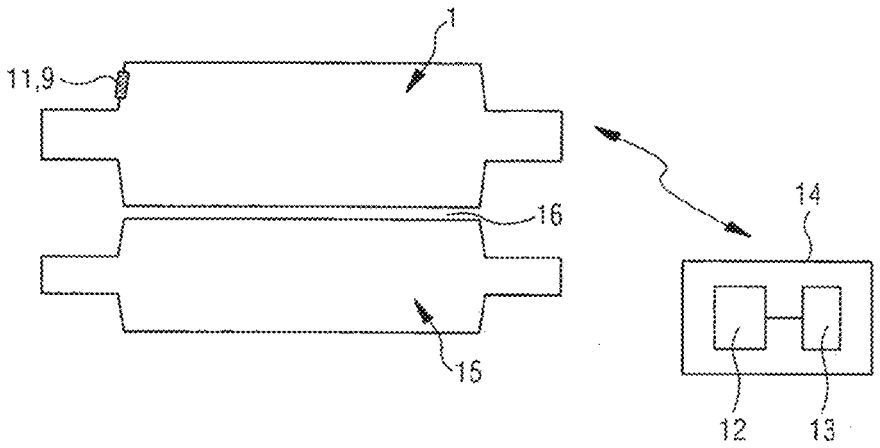
FIG. 3 shows the roll from FIG. 1, 2 or 4 in a roll nip configuration forming a with a counter roll

As can be seen from the representations of FIGS. 1 and 2, the connecting structure 4 is arranged radially between the roll core 2 and the functional layer 3 and on the roll core and in the present case comprises only one connecting layer 17. Furthermore, the outer-lying lateral surface of the functional layer 3, as seen in the radial direction RX of the roll, provides a contact surface 5 that can be brought into contact with a material web or a fabric covering. Embedded in the roll covering are a number of pressure- and/or temperature-sensitive sensors 6, which are arranged in the connecting layer 17, the sensors being formed as fiber-optic sensors 6 in the form of fiber Bragg grating sensors 6. As can be seen from the representation of FIGS. 1 and 2, sensors are arranged at a number of positions, in the present case three, spaced apart from one another by 90° in each case, as seen in the circumferential direction of the roll, a row of sensors 7 of which the sensors 6 are arranged one behind the other and at a distance from one another on a straight line extending in the axial direction AX of the roll being respectively arranged in a circumferential position. In the present case, each row of sensors 7 is formed by an optical waveguide 8 of glass fiber, in which the sensors 6 are incorporated.

As seen in the radial direction RX of the roll, the connecting layer 17 has a thickness D, the sensors 6 being arranged in the connecting layer 4 at a height H in the radial direction RX that corresponds to 80% of the thickness D of the connecting layer 17. Since the connecting layer 17 forming the connecting structure 4 has in the present case a thickness of 5 mm, the sensors 6 are arranged at a height of 4 mm above the lateral surface of the roll core 2. The functional layer also has a thickness of 12 mm.

In the present exemplary embodiment, the connecting layer 17 consists of a number of layers of glass fibers that are helically wound and impregnated with epoxy resin and has a hardness of 90 Shore D. In the present exemplary embodiment, the functional layer 3 consists of polyurethane and has a hardness of 90 Shore A. Consequently, the hardness of the connecting layer 17 is higher than the hardness of the functional layer 3.

The sensor roll 1 also comprises a signal processing unit 9, which is arranged outside the roll covering in the region of a roll cover 10 laterally bounding the roll core 2 and is part of the sensor roll 1. The signal processing unit 9 comprises a power supply unit (not shown), a multiplexer and a sending unit 11.

By means of the sending unit 11, signals from the sensors 6 can be transmitted wirelessly (indicated by a double-headed arrow) to a receiving unit 12, which is arranged outside the roll 1, is part of an evaluation unit 14 comprising an open-loop and/or closed-loop control unit 13 and communicates with the open-loop and/or closed-loop control unit 13. The open-loop and/or closed-loop control unit 13 can be used to control the operating state of a papermaking machine, to which the sensor roll 1 belongs and within which the sensor roll 1 forms a roll nip 16 with a counter roll 15.

Figure 4:
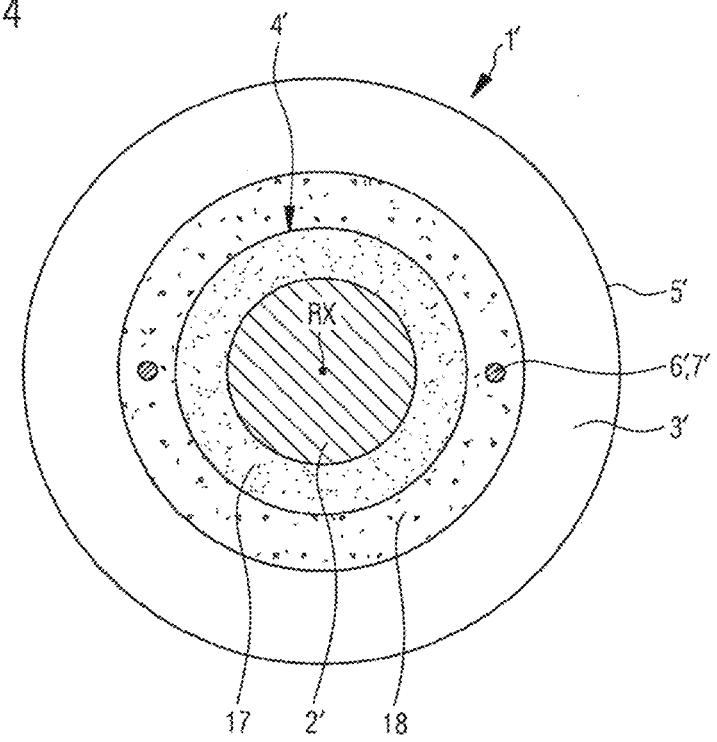
FIG. 4 shows a further exemplary embodiment of a roll according to the invention with sensors in section in the radial direction of the roll.

The roll 1' represented in FIG. 4 has a cylindrical roll core 2', the lateral surface of which is surrounded by a roll coating comprising a functional layer 3' and a connecting structure 4'.

As can be seen from the representation of FIG. 4, the connecting structure 4' is arranged radially between the roll core 2' and the functional layer 3' and on the roll core 2' and in the present case comprises a first connecting layer 17, arranged on the roll core 2', of hard rubber with a hardness in the range of 76-86 Shore D and a second connecting layer 18 of rubber with a hardness of 5-10 P&J, which is radially between the first connecting layer 17 and the functional layer 3'. Furthermore, the outer-lying lateral surface, as seen in the radial direction RX of the roll, of the functional layer 3' provides a contact surface 5' that can be brought into contact with a material web or a fabric covering. Embedded in the roll covering are a number of pressure- and/or temperature-sensitive sensors 6', which are arranged in the second connecting layer 18, the sensors being formed as fiber-optic sensors 6' in the form of fiber Bragg grating sensors 6'. As can be seen from the representation of FIG. 4, sensors are arranged at a number of positions, in the present case two, spaced apart from one another by 180° in each case, as seen in the circumferential direction of the roll, a row of sensors 7 of which the sensors 6 are arranged one behind the other and at a distance from one another in the axial direction AX of the roll being respectively arranged in a circumferential position, the sensors 6' being arranged, as seen in the circumferential direction of the roll 1', in a region that has a width in the circumferential direction of at most 5 cm. In the present case, each row of sensors 7' is formed by an optical waveguide 8' of glass fiber, in which the sensors 6' are incorporated. In the present exemplary embodiment, the functional layer 3' consists of rubber and has a hardness of 30 P&J. Consequently, the hardness of the connecting layers 17, 18 is higher than the hardness of the functional layer 3'.

The invention claimed is:

1. A roll for a machine for producing and/or processing a material web, the roll comprising:

a cylindrical roll core formed with a lateral surface;

a roll covering disposed on said lateral surface of said roll core, said roll covering including a functional layer and a connecting structure disposed to connect said roll core to said functional layer and having a plurality of connecting layers including an innermost connecting layer and a radially outermost connecting layer;

wherein a hardness and/or a modulus of elasticity of said connecting layers increases from layer to layer from said radially innermost connecting layer to said radially outermost connecting layer; and a plurality of pressure-sensitive and/or temperature-sensitive sensors embedded in said roll covering and disposed in said connecting structure or at a boundary surface between said connecting structure and said functional layer.

2. The roll according to claim 1, wherein at least some of said sensors are fiber-optic sensors.

3. The roll according to claim 2, wherein at least some of said sensors are fiber Bragg gratings.

4. The roll according to claim 3, wherein some or all of said fiber Bragg gratings of an optical waveguide have different Bragg wavelengths from one another.

5. The roll according to claim 2, which comprises at least one optical waveguide comprising a plurality of said fiber-optic sensors, and wherein said fiber-optic sensors of the same optical waveguide are arranged along said optical waveguide in such a way that between successive portions of said optical waveguide with fiber-optic sensors there are formed portions without fiber-optic sensors and portions with fiber-optic sensors.

6. The roll according to claim 2, which comprises a plurality of optical waveguides respectively comprising a plurality of fiber-optic sensors, wherein said optical waveguides are offset from one another, in a circum-circumferential direction of the roll, by 90°.

7. The roll according to claim 2, which comprises a plurality of optical waveguides respectively comprising a plurality of fiber-optic sensors, wherein said optical waveguides are offset from one another, in a circumferential direction of the roll, by 180°.

8. The roll according to claim 1, wherein said connecting layer in which said sensors are embedded or on which said sensors are disposed on a radially outer lateral surface has a greater hardness and/or a greater modulus of elasticity than said functional layer.

9. The roll according to claim 1, wherein each of said connecting layers has a greater hardness and/or a greater modulus of elasticity than said functional layer.

10. The roll according to claim 1, wherein said sensors are arranged on a radially outer lateral surface of one of said connecting layers at locations that do not form depressions with respect to other locations of the radially outer lateral surface.

11. The roll according to claim 1, wherein one of the following applies:

said sensors are embedded in said radially outermost connecting layer;

said sensors are arranged on a radially outer lateral surface of said radially outermost said connecting layer;

said sensors are embedded in said radially innermost connecting layer or are arranged on a radially outer lateral surface thereof;

said sensors are embedded in a connecting layer or are arranged on a radially outer lateral surface thereof that lies between said radially innermost connecting layer and said radially outermost connecting layer.

12. The roll according to claim 1, wherein said radially innermost connecting layer is formed from hard rubber or comprises hard rubber as a major constituent.

13. The roll according to claim 1, wherein said radially innermost connecting layer is formed from a fiber composite material or comprises fiber composite material as a major constituent.

14. The roll according to claim 13, wherein said fiber composite material is formed by fibers that are wound in a plurality of layers around said lateral surface of said roll core and embedded in a resin.

15. The roll according to claim 1, wherein said functional layer comprises a material selected from the group consisting of polyurethane, rubber, and a fiber composite material as a major constituent.

16. The roll according to claim 1, wherein said functional layer consists of a material selected from the group consisting of polyurethane, rubber, and a fiber composite material.

17. The roll according to claim 1, wherein, in a radial direction of the roll, said connecting structure has a given thickness and said sensors are arranged in the radial direction at a height in said connecting structure that corresponds to 50% or more of said given thickness.

18. The roll according to claim 17, wherein said sensors are arranged at a height in said connecting structure that corresponds to 80% or more of said given thickness of said connecting structure.

* * * * *